United States Patent [19]

Chunn

[11] 4,234,189

[45] Nov. 18, 1980

[54] EDUCATIONAL PLAYING CARDS

[76] Inventor: Robert E. Chunn, 1084 Dayton, #301, Aurora, Colo. 80010

[21] Appl. No.: 972,991

[22] Filed: Dec. 26, 1978

[51] Int. Cl.[3] ..... A63F 1/00

[52] U.S. Cl. ..... 273/299; 35/35 J; 273/302; 273/303

[58] Field of Search ..... 273/299, 303, 302; 35/35 J, 71

[56] References Cited

U.S. PATENT DOCUMENTS

| | | | |
|---|---|---|---|
| 1,332,249 | 3/1920 | Feero | 273/299 |
| 3,618,231 | 11/1971 | Nason | 273/299 X |

FOREIGN PATENT DOCUMENTS

| | | | |
|---|---|---|---|
| 1273490 | 5/1972 | United Kingdom | 273/299 |

*Primary Examiner*—Anton O. Oechsle

*Attorney, Agent, or Firm*—Edwin L. Spangler, Jr.

[57] ABSTRACT

There is disclosed herein a deck of educational playing cards consisting of fifty-two cards divided into four suits, each suit being representative of two different forms of speech and being so marked. Each card in each suit is representative of two different letters of the alphabet, and is so marked, the thirteen cards in each suit being representative of the twenty-six letters of the alphabet.

3 Claims, 4 Drawing Figures

EDUCATIONAL PLAYING CARDS

The invention pertains to educational and amusement devices or games, and more particularly to a deck of word-forming playing cards, useful as an accessory to various games which are educational as to the various principal forms of speech and as to spelling. The deck is unique in this field in that it corresponds to a standard deck of cards in comprising fifty-two cards divided into four suits of thirteen cards each. There have been prior patents on decks of word-forming playing cards (e.g., U.S. Pat. Nos. 622,240; 627,046; 1,528,060; 1,557,824; and, 2,265,334), but these have involved numbers of cards other than the standard number of fifty-two cards, and have had no educational function as to the forms of speech. The novel deck of this invention is based on my observation that there are eight principal forms of speech, namely, nouns, pronouns, verbs, interjections, adverbs, adjectives, prepositions and conjunctions, twice the number of suits as is desired in a deck of playing cards, and that there are twenty-six letters in the alphabet, half the number of cards as is desired in a deck of playing cards.

A deck of this invention comprises fifty-two playing cards, divided into four suits of thirteen cards each. Each suit is representative of two different forms of speech, and each card in each suit bears designations of the two different forms of speech represented thereby. Thus, the four different suits are representative of eight different forms of speech. Each card in each suit is representataive of two different letters of the alphabet, and bears designations of the two letters represented thereby. Thus, the thirteen cards in each suit are representative of the twenty-six letters of the alphabet. The deck therefore attains the object of corresponding to a standard deck of playing cards in having fifty-two cards divided into four suits of thirteen cards each, thereby being useful in playing a wide variety of card games, including standard games. For example, it is possible to play rummy-type games, in which sequences of cards spelling words are required to be made, with each sequence being in a suit denoting a particular form of speech. Another novel type of game that may be played will be described below, and it will be apparent that many different games may be played which are educational as to both spelling and the different forms of speech.

Figure 1:
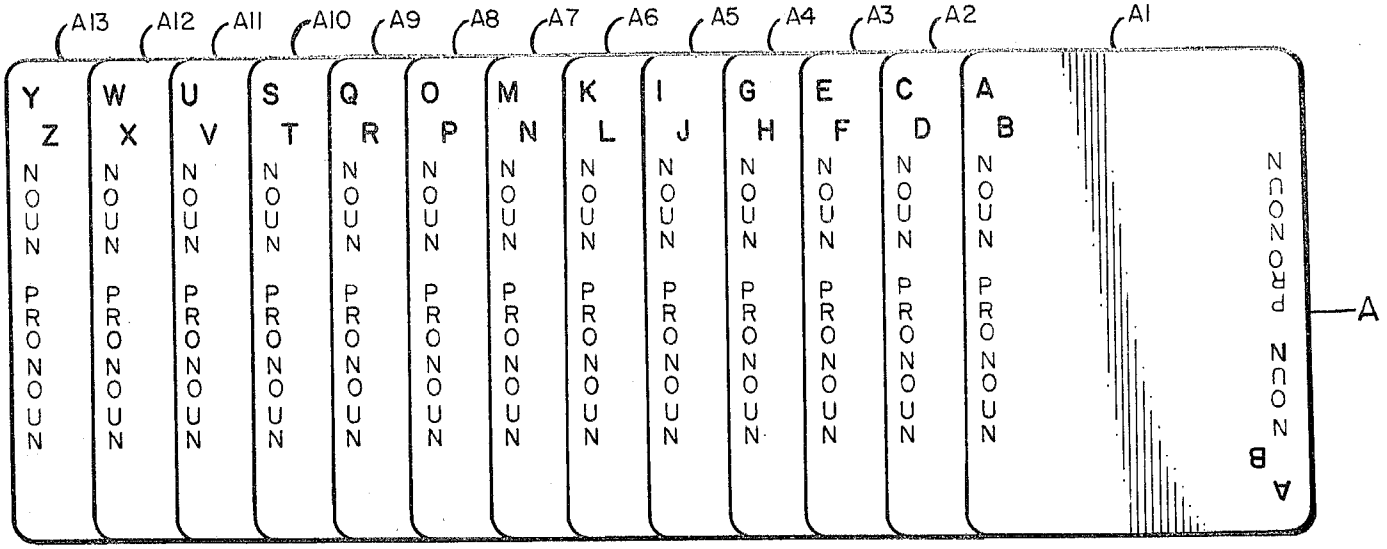
Figure 2:
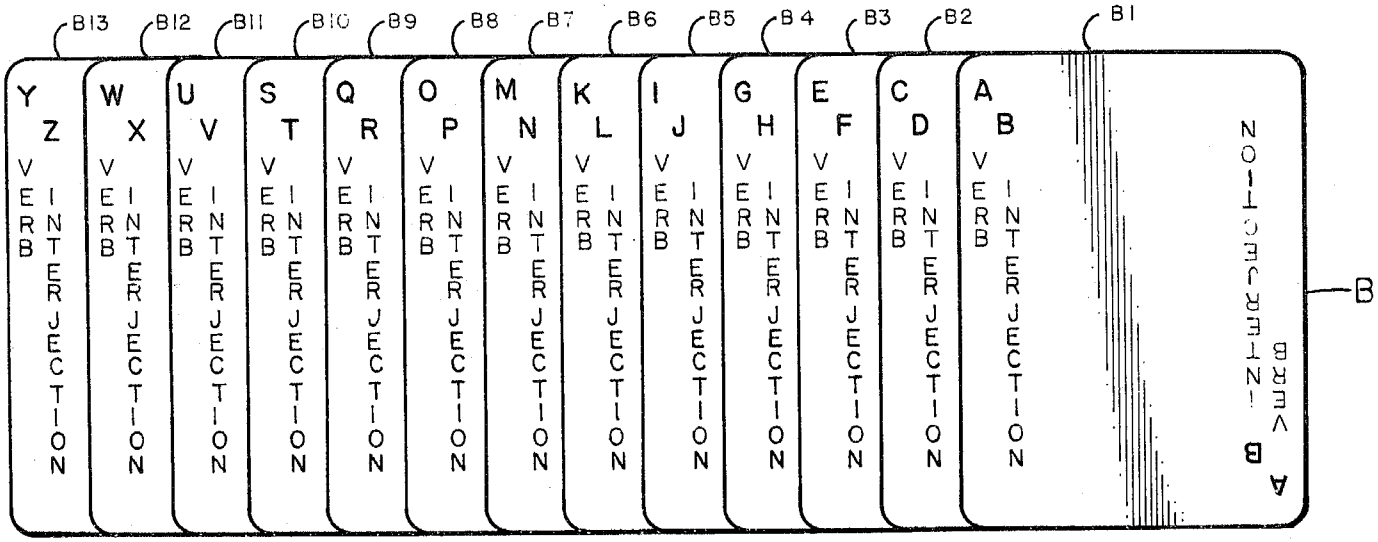
Figure 3:
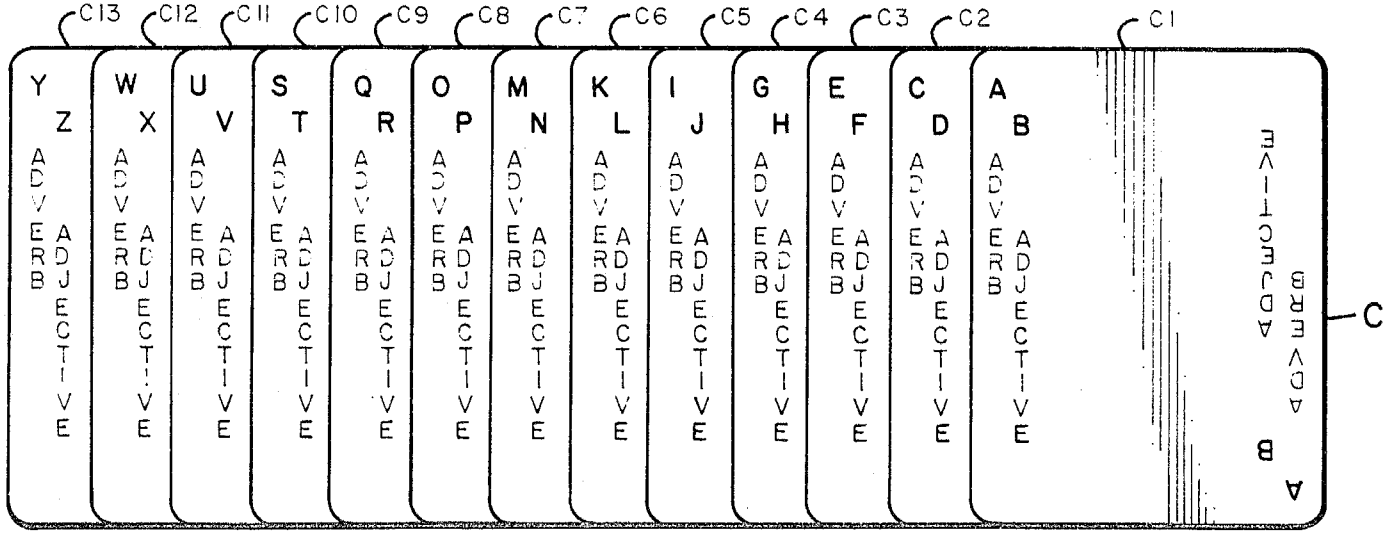
Figure 4:
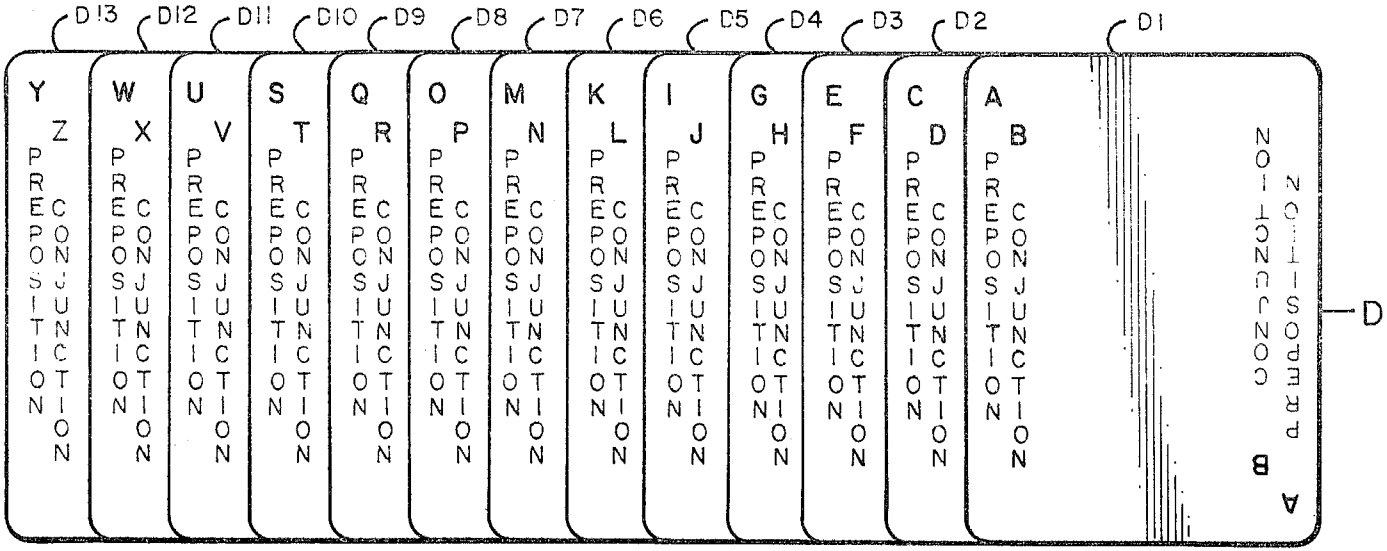

Other objects and features will be in part apparent and in part pointed out hereinafter in connection with the description of the drawings that follows, and in which:

FIGS. 1–4 are views showing the four different suits of a deck of playing cards of this invention.

Referring to the drawings, a deck of playing cards of this invention is shown to comprise fifty-two cards divided into four suits of thirteen cards each. The four suits, shown separately in FIGS. 1–4, are respectively designated A, B, C and D. The thirteen cards in suits A–D are respectively designated A1–A13, B1–B13, C1–C13 and D1–D13. Suit A is representative of nouns and pronouns, and each of cards A1–A13 in this suit bears the designations NOUN and PRONOUN. Suit B is representative of verbs and interjections, and each of cards B1–B13 in this suit bears the designations VERB and INTERJECTION. Suit C is representative of adverbs and adjectives, and each of cards C1–C13 in this suit bears the designation ADVERB and ADJECTIVE. Suit D is representative of prepositions and conjunctions, and each of cards D1–D13 in this suit bears the designation PREPOSITION and CONJUNCTION.

Each card in each suit is representative of two different letters of the alphabet. Thus, as to each suit, the thirteen cards, respectively, bear the pairs of letters A and B, C and D, E and F, G and H, I and J, K and L, M and N, O and P, Q and R, S and T, U and V, W and X, and Y and Z. For example, card A1 of suit A bears the letters A and B, card A2 bears the letters C and D, etc.

As to any card, its suit may be observed from the designation of the forms of speech thereon, e.g., a card may be readily observed as in the noun-pronoun suit simply by reference to the words NOUN and PRONOUN thereon. However, the suits may be made more readily distinguishable by printing the words of the suits in different colors. For example, the letters and the words on the cards in suit A may be printed in black, those on the cards in suit B printed in red, those on the cards in suit C printed in green, and those on the cards in suit D printed in blue. Also, as shown, each card may have the pairs of letters for that card printed at diagonally opposite corners of the card and the form of speech designations printed at opposite sides of the card in reversed relationship.

Since the deck corresponds to a standard deck of playing cards in respect to comprising four suits of thirteen cards each, it may be used in playing various games corresponding to standard card games, e.g. rummy-type games as above noted, and it may also be used in new games such as the following game which may be played by two, three or four players:

Assuming there are four players in the game, each player is dealt thirteen cards. A word is selected from a compilation of suitable words. The form of speech of the selected word determines the trump suit. For example, assuming the selected word is SKYWARD, which is an adverb or adjective, the adverb-adjective suit is thereby established as the trump suit. The cards also are valued in accordance with the selected word. For example, again assuming the selected word is SKYWARD, cards with S on them are of the highest value, cards with K on them are second highest, etc. Cards with letters on them not in the selected word are valued in sequence after the last letter of the selected word. For example, again referring to SKYWARD as the selected word, in which D is the last letter, the C-D cards would be the cards of seventh value, and then would follow the E-F cards, G-H cards, I-J cards, etc. through the alphabet (excluding the cards bearing the letters S, K, W and R) to the U-V cards which would be of lowest value. This value sequence becomes readily apparent simply by arranging the cards in the hand by suits and by order in each suit according to the selected word. Play proceeds by the player to the left of the dealer playing a card. Each player must then follow suit, unless he is out of that suit, in which case he must play trump, or, if out of trump, any card at his discretion. If a trump is led, and the next player has a higher trump, he must play it. The player playing the highest card wins the play, meaning that he captures the four cards played. The object of the game is to score points by capturing all the letters of the selected word, secondly by capturing letters in any syllable of the selected word, (e.g. SKY or WARD), thirdly by capturing letters of the word, and fourthly by capturing cards. Points are preferably given as follows: one point for each card captured, two points for each card captured bearing a letter of the selected word and four points for each card captured bearing two letters of the selected word, three points for each captured syllable of the selected word, and, for capturing all the letter of the selected word, three times the number of syllables, plus a bonus of five points for capturing the word in trump. The mode of play and scoring emphasizes the part of speech the selected word is, the syllables of the word, and the spelling of the word, and the game and the mode of scoring are extremely conducive toward education of the players in these respects.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limited sense.

What is claimed is:

1. For use in a card game: a deck of fifty-two playing cards divided into four suits of thirteen cards each, each suit being representative of two different forms of speech, and the four different suits being representative of eight different forms of speech, each card in each suit bearing designations of the two different forms of speech represented thereby, each card in each suit displaying two different letters of the alphabet, the thirteen cards in each suit displaying all twenty-six letters of the alphabet, corresponding cards in all four suits displaying the same two letter combinations; and means for determining trump, said trump determining means comprising a complication of words, the selection of one of which determines trump according to the form of speech of the selected word.

2. A deck of playing cards as set forth in claim 1 wherein the four different suits represent nouns, pronouns, verbs, interjections, adverbs, adjectives, prepositions and conjunctions, and each card in each suit bears designations of two of these.

3. A deck of playing cards as set forth in claim 2 wherein, as to each suit, the thirteen cards, respectively, bear the pairs of letters A and B, C and D, E and F, G and H, I and J, K and L, M and N, O and P, Q and R, S and T, U and V, W and X, and Y and Z; and, wherein the trump-determining combinations comprise, respectively, nouns and pronouns, verbs and interjections, adjectives and adverbs, and prepositions and conjunctions.

* * * * *